United States Patent [19]

Schulze

[11] Patent Number: 5,042,362

[45] Date of Patent: Aug. 27, 1991

[54] HYDRAULIC CONTROL SYSTEM FOR THE DRIVE CONTROL OF A DOUBLE-ACTING HYDRAULIC CYLINDER

[76] Inventor: Eckehart Schulze, Stahlbühlstrasse 36, D-7251 Weissach, Fed. Rep. of Germany

[21] Appl. No.: 338,223

[22] Filed: Apr. 14, 1989

[30] Foreign Application Priority Data

Apr. 29, 1988 [DE] Fed. Rep. of Germany ..... 3814580

[51] Int. Cl.[5] ..... F15B 13/04

[52] U.S. Cl. ..... 91/29; 91/417 R; 91/436

[58] Field of Search ..... 91/436, 415, 417, 235, 91/321, 29, 33

[56] References Cited

U.S. PATENT DOCUMENTS

| | | | |
|---|---|---|---|
| 946,481 | 1/1910 | Anderson | 91/29 |
| 2,356,366 | 8/1944 | Wise | 91/29 |
| 3,604,884 | 9/1971 | Olsson | 91/415 |
| 4,216,702 | 8/1980 | Brundidge | 91/436 |

*Primary Examiner*—John T. Kwon
*Assistant Examiner*—F. Daniel Lopez
*Attorney, Agent, or Firm*—Antonelli, Terry, Stout & Kraus

[57] ABSTRACT

A hydraulic control system for the drive control of a double-acting hydraulic cylinder with a larger driving surface and a smaller countersurface, in which the direction- and movement-controlling valve is provided in the form of a follow-up adjusting valve that operates with an electrically-controlled indication of the set value and with a mechanical announcement of the actual position. The pressure source provides two different supply pressures $P_N$ and $P_H$. A pressure-controlled pressure-reversing valve is provided to switch to the higher supply pressure as and when this is called for by a growing load. A similarly pressure-controlled surface-reversing valve is also provided and, after the pressure-reversing valve has switched to the higher pressure, will itself switch the hydraulic cylinder from a differential operating mode to a mode in which pressure is applied only to the larger working surface of its piston. Alterntery, after the demand for forward driving force has diminished again, so that the pressure-reversing valve will have switched back to the lower pressure, it will itself switch the hydraulic cylinder back into the differential operating mode.

23 Claims, 2 Drawing Sheets

PN 60BAR
PH 180BAR
T
P

HYDRAULIC CONTROL SYSTEM FOR THE DRIVE CONTROL OF A DOUBLE-ACTING HYDRAULIC CYLINDER

BACKGROUND OF THE INVENTION

The present invention relates to a control system for a control drive of a double-acting hydraulic cylinder provided as a drive unit for a working tool of a processing machine by which a work piece, such as, for example, a steel plate, can be subjected to cold deformation actions such as punching or embossing.

A control system of the aforementioned type, used in conjunction with a hydraulic drive unit, is disclosed in, for example, unpublished German Patent Application P 37 35 123.0, wherein the drive unit includes a linear hydraulic cylinder constructed as a double-acting cylinder 1, with a double-diameter piston and dimensioned in such a way that a ratio $F_A/F_G$ between a larger driving surface $F_A$ and a smaller surface or countersurface $F_G$ amounts to about $\frac{1}{3}$. The fast forward movements of the hydraulic cylinder piston and the tool, movements by which the tool is brought towards the work piece and also caused to perform a part of the processing, are obtained by a forward motion cycle in which pressure is applied to both the surfaces $F_A$ and $F_G$ of the hydraulic cylinder piston, in the former case through a directional control valve, in the latter case through a pressure-controlled valve element of a surface-reversing valve. If the force thus developed by the piston in differential operation is insufficient to ensure, for example, the tool punching completely through the work piece, the surface-reversing valve, controlled by the pressure in the smaller driving pressure space of the hydraulic cylinder as soon as that pressure exceeds a certain threshold value, lying a preset amount below the maximum value of the output pressure of the pressure source, is switched into its position associated with forward movements under load. In this position the smaller driving pressure space of the hydraulic cylinder is relieved of pressure so that only the larger driving pressure space remains connected to the pressure output of the pressure source and becomes subject to a pressure of, for example, 200 bar. In order to avoid repeatedly switching the surface-reversing valve "to and fro" in cases where the required forward driving force is only slightly greater than the maximum force that can be obtained by differential operation of the cylinder, which, in unfavorable circumstances would not only retard the working process but could even lead to the piston stopping "dead" in a given position, the surface-reversing valve is constructed in such a manner that it will switch back to differential operation only after the required forward driving force has become smaller than the maximum forward driving force obtainable in differential operation of the hydraulic cylinder by an amount corresponding to a preset safety margin.

The hydraulic control system according to the above-noted German Application P 37 35 123.0 operates satisfactorily inasmuch as advantageously short working cycle times are obtained in numerous cases where the forward driving force, obtained by differential operation of the hydraulic cylinder, is more or less sufficient and the reversing valve is therefore obliged to switch to one-sided cylinder operation only in some very rare cases. If these short cycle times are to be duly exploited, which is particularly advantageous when one has to punch through a relatively thin sheet of steel, and sufficient power reserves are yet to remain available for processing thicker steel plates, a relatively high value must necessarily be chosen as the ratio between the two working surfaces of the hydraulic cylinder. But this means that once the surface-reversing valve has been excited, a correspondingly large increase in the maximum available forward driving force is obtained and this, even while the tool is still engaged in punching through, can lead to a considerable acceleration of the hydraulic cylinder piston, which will therefore have to be slowed down as soon a the reversing valve has switched back to differential operation of the cylinder. This process can lead to considerable jerking motion or action, and the jerking motion or action become all the more likely when the tool finds it relatively "easy" to punch through the work piece and thus facilitates the "bolting" of the driving cylinder before the piston can be slowed down by being switched back to differential operation.

It is quite true that one could think of attenuating the jerking motion or action by constructing the directional valve and or the movement control valve as an adjustable valve, say, some known type of follow-up adjusting valve. But this remedial measure by itself would not make any appreciable contribution to smoothing a working cycle of the type here described, not even if one were to use a follow-up adjusting valve with mechanical feedback of the actual value or position, because the regulating frequency of such a valve would still be relatively small as compared with the time interval in which these shocks can occur, so that the jerking motion or action would not be prevented in actual practice.

Likewise, the double-acting hydraulic cylinder, with one driving surface and one countersurface could possibly be replaced by another in which two driving surfaces are arranged in such a manner that the second can either reinforce or attenuate the forward driving force of the first and, controlling the pressure applied to these working surfaces by a follow-up adjusting valve. But this would call for an extremely costly design of the hydraulic cylinder itself and it would no longer be possible to use some standard unit and adapt such unit to the particular requirements of the case by adding an appropriate control peripheral equipment.

An object of the present invention resides in providing an improved control system of the aforementioned type which permits the control system to be used in conjunction with a simple double-acting cylinder as the driving unit of a hydraulic drive system and, notwithstanding a simple overall structure, to make it possible to obtain non-jerky operation of the system, if necessary even when the machine equipped with the drive has to be operated with a high-speed sequence of working cycles.

In accordance with advantageous features of the present invention, a hydraulic control system for a drive control of a double-acting hydraulic cylinder, provided as a drive unit of a processing machine in which a work piece, such as, for example, a steel plate is subjected to cold deformation, such as, for example, punching or embossing, is provided wherein a pressure source unit supplies pressures which can be made available at different pressure levels such as, for example, a lower pressure level, $P_N$ and a higher pressure level $P_H$ with an automatic switching to a required pressure level being achieved by a pressure-controlled reversing valve capable of a very fast switching operation. A switching of the surface-reversing valve takes place only after the pressure-controlled reversing valve has switched the pressure source unit either in a direction of the high pressure level $P_H$ or the lower pressure level $P_N$. Additionally, with the above measures, a continuous adjustment in line with requirements of the operating pressure $P_H$ prevailing in a larger driving pressure space of the hydraulic cylinder by a follow-up adjusting valve operating with an electric signal or indication of a set value of in mechanical feedback of the actual value is effected.

By virtue of the above-noted features of the present invention, a substantially jerk-free and smooth sequence of working cycles is obtained, because with the above combination of measures, the follow-up adjusting valve, which, due to the aforementioned pressure switching, is effective with smaller displacements of through flow regulating valve elements so that the adjusting valve can act more "quickly" thereby making possible higher regulating frequencies which, in turn, are of a benefit in avoiding a jerking motion of the piston and tool. The control system of the present invention therefore insures comfortable and substantially noise-free operation of the machine even when fast working cycle sequences are being performed.

A "slowing down" of the piston of the driving cylinder during the final phase of the processing of the work piece will take place only after the pressure supply has been switched back to the lower pressure level $P_N$, thereby greatly facilitating the slowing down process.

Bearing in mind that even the control system described in the aforementioned German Patent Application, depending on the purpose for which it is used, can be equipped with a follow-up adjusting valve as the directional control valve, possibly to ensure ready control of the execution of the movements when a CNC control is used, to realize a comparable control system in accordance with the present invention, the pressure source is constructed having two different output pressures and providing a pressure-reversing valve arrangement for permitting these different output pressure levels to be exploited as required. In technical terms, any additional cost incurred is rather small, so that the control system according to the invention can be considered as "simple" and the total cost of the driving and control system are not on the whole greatly increased by this additional technical effort, while a jerk-free operation of the machine is made possible. Moreover, the present invention reduces wear and tear and, consequently, the slightly greater investment costs have to be viewed against markedly smaller operating costs that greatly overcompensate the somewhat higher initial investments.

In accordance with the present invention, in a course of a processing cycle, the tool performs a fast forward movement towards the work piece, a working stroke in which the work piece is actually deformed, and a fast return movement to bring the tool back into a starting position for the next processing cycle.

In the present invention, the hydraulic cylinder has a total of two driving pressure spaces that are delimited in a mobile but pressure-type manner by different side surfaces $F_1$ and $F_2$ of a driving piston of the hydraulic cylinder, which driving piston is constructed as a double-diameter or differential piston.

By virtue of the provision of a double-diameter piston, it is possible, when driving and/or operating pressures derive from an output pressure of a pressure source are applied to both piston surfaces $F_1$, $F_2$, to control the feed and working movements of the tool in a fast forward operation. Additionally, when pressures applied only to a larger piston surface $F_1$, while the smaller piston surface $F_2$ is relieved of pressure, it is possible to control to forward working movements under a load that calls for a greater forward driving force.

Furthermore, by virtue of the double-diameter piston, when pressure is applied only to its smaller piston surface $F_2$, while the large piston surface $F_1$ is relieved of pressure, it is possible to control the fast return movements of the tool.

In accordance with further advantageous features of the present invention, an electrically-controlled directional control valve by which it is possible, upon switching the control valve into alternative operating positions to control the stroke and speed of the forward and return movements of the tool. In one of the operating positions of the control valve, pressure is applied to the driving pressure space of the hydraulic cylinder delimited by the larger piston surface $F_1$, with the other operating position being associated with depressurizing the driving pressure space.

Advantageously, according to the present invention, a surface-reversing valve is provided and controlled by the pressure prevailing in the larger driving pressure space of the hydraulic cylinder, with the surface-reversing valve being adapted to be switched from an operating position associated with fast forward operation in which the pressure outlet of a pressure source is connected to the driving pressure space of the hydraulic cylinder delimited by the smaller piston surface $F_2$, into an alternative position associated with the fast forward motion under a greater load in which the smaller driving pressure space of the hydraulic cylinder is relieved of pressure. By discharging the pressure from the larger driving pressure space $F_2$ of the hydraulic cylinder, the surface-reversing valve can then be made to switch back into an operating position in which the smaller driving pressure space of the hydraulic cylinder is again connected to the pressure outlet of the pressure source.

The switching of the surface-reversing valve to a fast forward operation of the hydraulic cylinder under a load, in accordance with the present invention, will take place when the operating pressure i the larger driving pressure space of the hydraulic cylinder exceeds a value that corresponds to a large fraction, for example, 85% of the maximum obtainable operating pressure $P_H$.

A subsequent switching of the surface-reversing valve into the operating position associated with the fast forward and return movements of the hydraulic cylinder takes place when the operating pressure prevailing in the larger driving pressure space of the hydraulic cylinder understeps a value that corresponds to a substantially smaller fraction, of for example, 30% to 50%, of the maximum exploitable operating pressure of the hydraulic cylinder.

A directional control valve of the present invention is constructed as a conventional follow-up adjusting valve which operates with an electronically controlled indication of a set value. The control is provided, for example, by a stepper motor with a mechanical feedback such as, for example, a worm gear, of the actual position making it possible to obtain a continuous variation of the operating pressure $P_A$ prevailing in the larger driving pressure space of the hydraulic cylinder.

In addition to a first pressure outlet where the pressure supply is available a relatively low pressure $P_N$, according to the present invention, the pressure source also has a second pressure outlet where the pressure supply is provided at a markedly higher pressure level $P_H$.

The pressure-reversing valve arrangement is controlled by the operating pressure $P_A$ prevailing in the larger driving pressure space of the hydraulic cylinder and which, when and for as long as the operating pressure PA prevails in the larger driving pressure space of the hydraulic cylinder remains smaller than a switching threshold corresponding to a large fraction of, for example, 85% to 95% of the output pressure $P_N$ made available at the low-pressure outlet of the pressure source, will connect the low-pressure outlet to the pressure supply connection follow-up adjusting valve. Alternatively, when and for as long as the operating pressure $P_A$ prevailing in the larger driving pressure space of the hydraulic cylinder remains above the switching threshold, the pressure-reversing valve arrangement will connect the high-pressure outlet of the pressure source to the pressure supply connection of the follow-up adjusting valve.

In accordance with the present invention, the surface-reversing valve is constructed in such a manner that the switching threshold, upon being understepped, triggers the switching back of the surface reversing valve into an operating position associated with the fast operating modes of the hydraulic cylinder that is lower than the switching threshold of the pressure reversing valve.

The pressure switching valve arrangement can be realized by a simple non-return valve that causes the pressure outlets of the pressure source to become cut off.

According to the present invention, the pressure reversing valve arrangement comprises a pressure-controlled 2/2-way valve that, for as long as the operating pressure in the larger driving pressure space of the hydraulic cylinder remains lower than its switching threshold, is maintained in a basic position in which the pressure supply connection of the follow-up adjusting valve is cut off from the high-pressure outlet of the pressure source. Furthermore, when and for as long as the operating pressure in the greater driving pressure space of the hydraulic cylinder is higher than the switching threshold ($b_1 \cdot P_N; 0.5 < b_1 < 0.95$), the pressure reversing valve arrangement switches into an open position in which the high-pressure outlet is connected to the pressure supply connections of the follow-up adjusting valve.

The pressure reversing valve arrangement according to the present invention also includes a non-return valve inserted between the pressure supply connection of the follow-up adjusting valve and the low-pressure outlet of the pressure source, with the non-return valve being maintained in a closed position for as long as the pressure at the pressure supply connection of the follow-up adjusting valve is higher than the output pressure of the low-pressure output of the pressure source.

Advantageously, the 2/2-way valve may constructed as a slide valve and, for the purposes of setting restoring forces in adjusting the switching threshold desired in each particular case, the slide valve may, for example, be provided with an adjustable return spring capable of having its return force set as required.

The pressure-reversing valve, constructed as a slide valve, includes a piston which is adapted to be displaced or pushed into its basic position by a return force of a preset magnitude, with the slide valve including a control end flange that delimits, in a mobile manner, one side of a control pressure space. An area $f_2$ of a surface of the end flange is dimensioned so that a force that has to be exerted in order to cause the pressure reversing valve to switch into an operating position in which the high pressure outlet of the pressure source is connected to the pressure supply connection of the follow-up adjusting valve requires a pressure $P_A$ determined by the following relationship:

$$P_A \leqq P_N \cdot b_1,$$

where:

$P_N$ = pressure supplied by the low pressure outlet means of the pressure source means;

$b_1$ = a coefficient less than unity, ($0.85 < b_1 \leqq 0.95$, and preferably amounts to 0.95).

In order to exploit the lower output pressure of the pressure source in a very simple manner for the purposes of producing the restoring force that is needed for setting the reversing threshold, in accordance with the present invention, the valve piston of the pressure-reversing valve includes another end flange at an end facing away from the control pressure space in which the prevailing operating pressure $P_A$ is the same as the output pressure of the follow-up adjusting valve that is applied to the larger driving pressure space of the hydraulic cylinder. The other end flange forms a mobile delimitation of a control pressure space of the pressure-reversing valve in which there permanently prevails the output pressure $P_N$ available at the low pressure outlet of the pressure source.

The pressure-reversing valve of the present invention is advantageously constructed so no elastic spring elements of any type are necessary for setting the pressure-reversing valve to a desired pressure-setting threshold. Moreover, at least one part that would otherwise be subject to considerable wear and tear also becomes superfluous.

For this purpose, according to the present invention, a ratio $f_1/f_2$ between the areas $f_1$ and $f_2$ of the end flanges to which are respectively applied the output pressure $P_A$ of the follow-up adjusting valve and the lower output pressure $P_N$ of the pressure source, has the value $B_1$. Moreover, the valve piston of the pressure-reversing valve is constructed as a free piston.

By dimensioning the working surfaces of the control valve piston and providing a clear cross sectional area of the valve channel of a seat of the valve, upon dually observing such dimensioning, a high reliability of operating control is insured. More particularly, according to the invention, the valve element of the surface cycle reversing valve, which in an open position causes the pressure to become discharged from the smaller driving space of the hydraulic cylinder, is constructed as a non-return valve which, in an opening position, sustains the operating pressure $P_A$ of the smaller driving pressure space of the hydraulic cylinder prevailing in a central valve chamber of the surface cycle reversing valve. A force with which the precompressed valve closing spring pushes a valve body of the non-return valve into a blocking position is equivalent to an opening pressure that corresponds to a large fraction $b_2(0.85 < bP-$ 2<0.95) of the higher pressure $P_H$ available at the high-pressure outlet of the pressure source.

Advantageously, according to the present invention, the surface-reversing valve includes another valve element fashioned as a slide valve that, for as long as the non-return valve remains in its blocking position, assumes an open position in which the lower output pressure $P_N$ of the pressure source is applied to the smaller driving pressure space of the hydraulic cylinder. Upon an opening of the non-return valve, the other valve switches into its blocking position in which smaller driving pressure space of the hydraulic cylinder becomes cut off from the low-pressure outlet of the pressure source.

When the slide of the additional valve element is constructed as a stepped piston, a weakly precompressed return spring pushes into supporting contact with the valve body of the non-return valve thus maintaining the same in an operating position in which even a displacement of the stepped piston amounting to no more than a small fraction of the opening stroke of the non-return valve or the closing stroke of the slide valve will be quite sufficient to bring the slide valve into a blocking position in which one side of the stepped piston becomes depressurized while a working surface $F_5$ of its other side, namely, the one that delimits the control pressure space in which there prevails the operating pressure $P_A$ of the larger driving pressure space of the hydraulic cylinder becomes subjected to the pressure $P_A$. Moreover, the ratio $F_4/F_5$ between the control surface $F_5$ in the cross sectional area $F_4$ surrounded by a valve seat of the seat valve is such so that within the area $F_4$ the valve body becomes subjected to the pressure prevailing in the smaller driving pressure space of the hydraulic cylinder for as long as the non-return valve remains in the blocking position, with the ratio $F_4/F_5$ satisfying the following relationship:

$$F_4/F_5 \leqq (b_1 \cdot P_N + a)/(b_2 \cdot P_H),$$

where:

$b_2$ equals a coefficient less than unity ($0.85 < b_2 < 0.95$) defining an amount by which the operating pressure $P_A$ at which the seat valve opens may understep a maximum possible operating pressure $P_H$; and a equals a small safety margin of, for example, 2% to 10%.

In accordance with still further features of the present invention, the parameter $b_1$ has a value of between 0.85 and 0.95 and, preferably, close to 0.9; whereas, the parameter $b_2$ has a value of between 0.8 and 0.95 and, preferably, close to 0.9.

The ratio $F_1/F_3$ between the cross-sectional area $F_1$ of the large driving pressure space of the hydraulic cylinder and the cross-sectional area of the $F_3$ of the smaller working surface of the hydraulic cylinder is between 1.5 and 3 and, preferably 2.

Advantageously, the larger working surface $F_1$ of the hydraulic cylinder has an area of between 60 $cm^2$ and 300 $cm^2$ and, preferably close to 100 $cm^2$.

Moreover, a ratio $P_A$ between the high and low output pressures $P_H$ and $P_N$ of the pressure source has a value of between 4 and 2 and, preferably, a value close to 3.

Additionally, the output pressure level at the low-pressure outlet of the pressure source is between 50 bar and 80 bar and preferably, has a value of near 60 bar. The above and other objects, features, and advantages of the present invention will become more apparent from the following description when taken in connection with the accompanying drawings which shall, for the purposes of illustration only, one embodiment when in accordance with the present invention.

DETAILED DESCRIPTION

Figure 1:
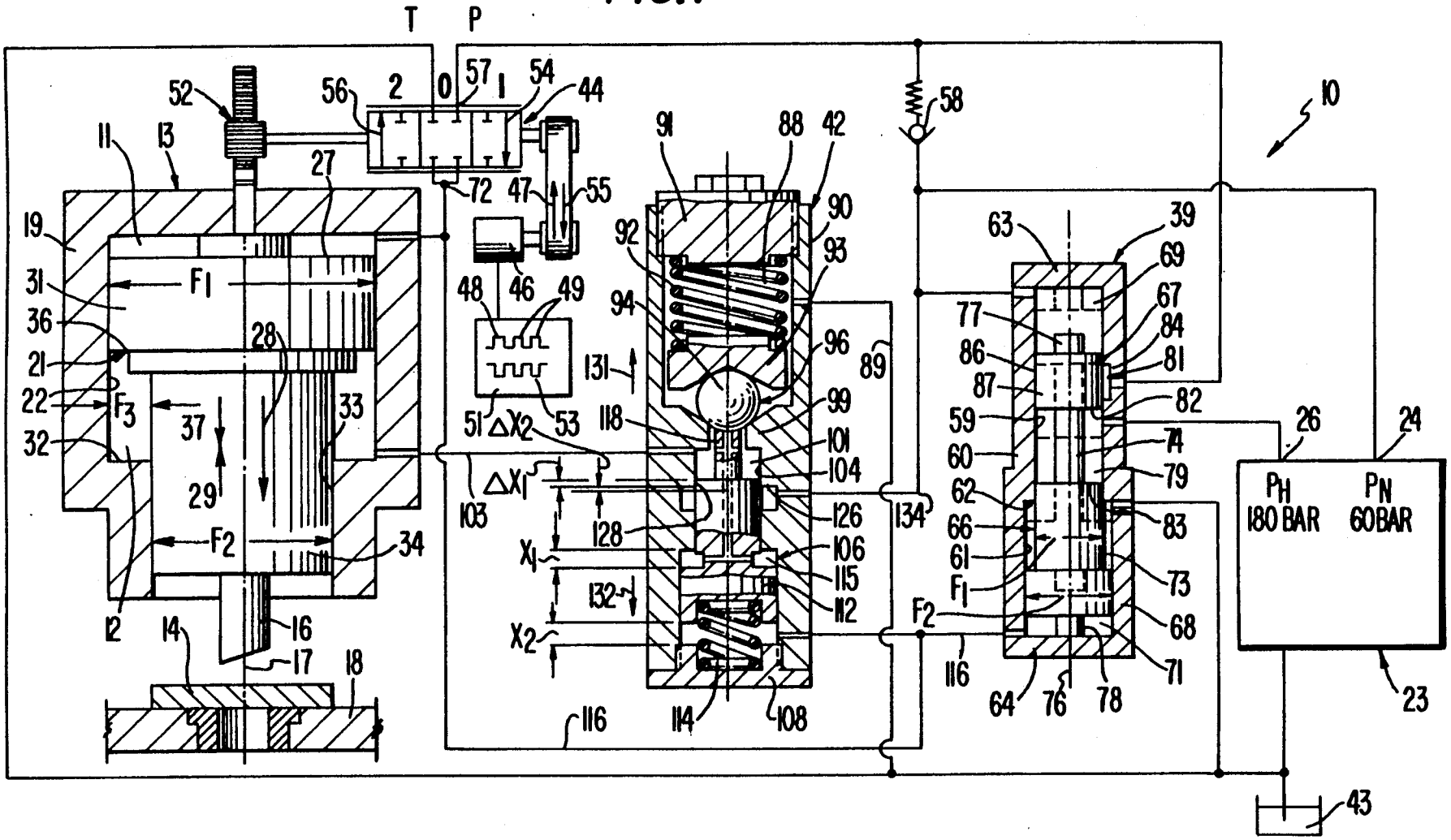
FIG. 1 is a partially schematic cross-sectional view of a hydraulic layout of a control system according to the present invention for a hydraulic drive with a double-acting hydraulic cylinder as a drive unit.

Referring now to the drawings wherein like references numerals are used throughout the various views to designate like parts and, more particularly to FIG. 1, according to this figure, a hydraulic control system generally designated by the reference numeral 10 applies pressure to and/or discharges pressure from driving pressures spaces 11 and/or 12 of a linear double-acting cylinder generally designated by the reference numeral 13 in such a manner as may from to time be required. The double-acting hydraulic cylinder forms a drive unit for a tool 16 in a punching or embossing machine or, more generally, a processing machine by which a work piece 14 such as, a steel plate is subjected to cold deformation actions such as punching or embossing.

The tool 16, during a course of a working cycle, performs a fast forward movement in a direction of the work piece 14, by which the tool 16 is brought into contact with the work piece 14. Thereafter, if necessary, under an action of a greater force acting in a forward direction in at a reduced forward speed, the punching tool 16 performs the forward movement under load that actually carries out the processing of the work piece 14. Thereafter, once a desired deformation has been impressed upon the work piece 14, the drive unit performs a fast return movement that brings the tool 16 back into the basic position in which the tool found itself at the beginning of the working cycle, and at which position the fast return movement is once again performed in conditions where the double-acting hydraulic cylinder develops a smaller force, while the tool 16 moves at a greater speed for the individual processing operations, where priority is to be attributed to reducing the cycle times.

In a non-limitive sense, in the drawings, hydraulic cylinder 13 is presumed to be arranged in a vertical or standing position with a longitudinal axis 17 thereof forming a right angle with a horizontally arranged machine table 18, and the housing 19 of the hydraulic cylinder 13 is rigidly attached to the machine table 18.

The work piece lying on the machine table 18 can either be fixed to the machine table 18 or, by conventional numerical control techniques be moved relative to the machine table 18 along a given processing path; however, in either case, the work piece 14 is attached to a holding device (not shown).

The hydraulic cylinder 13 includes a differential cylinder 19 slidably accommodating a double-diameter piston generally designated by the reference numeral 21 so as to be moveable to and from within the cylinder housing in a cylinder bore generally designated by the references numeral 22. The double-diameter piston provides a pressure-type barrier between two driving pressure spaces 11, 12 so that when the output pressure $P_N$ or $P_H$ of a conventional pressure source generally designated by the reference numeral 23 is applied either jointly or alternatingly to the two driving pressure spaces 11, 12 or, alternatively, one of the driving pressure spaces 11 or 12 is relieved of pressure, the forward and return displacements of the piston 21 needed for the purposes of processing the work piece 14 can be controlled "as from time to time required".

The pressure source 23 has a first pressure-supply outlet 24 for providing a relatively low pressure $P_N$, which may have a typical value of 60 bar, and a second pressure-supply outlet 26, where a clearly higher pressure $P_H$ having a typical value of 180 bar.

The effective size of the larger piston surface 27 of the piston 21 of the hydraulic cylinder 13 that, as shown in FIG. 1, delimits the upper driving pressure space 11 of the hydraulic cylinder 13, is equal to cross section area $F_1$ of the bore 22 of the cylinder housing 19.

When the output pressure $P_A$ of the pressure source 23 is applied to the driving pressure space 11 of the hydraulic cylinder, the piston 21 is subjected to a force $K_1$ acting in a direction of the arrow 28, i.e. towards the work piece 14, with the magnitude of the force being given by the following equation:

$$K_1 \quad F_1 \cdot P_A, \tag{1}$$

$K_1$ = force acting in a direction of arrow 28;
$F_1$ = cross-section of larger piston surface; and
$P_A$ = output pressure $P_N$ or $P_H$.

When pressure is applied, either simultaneously or alternately, to the lower driving pressure space 12 of the hydraulic cylinder 13, the piston 21 is subjected to a force $K_2$ acting in a direction of the arrow 29, i.e. in the opposite direction, with the magnitude of the force being given by the following equation:

$$K_2 = F_1 \cdot P - (F_1 - F_2) \cdot P = = F_1 \cdot P_G - F_3 \cdot P \tag{2},$$

where:

$P_G$ = a pressure prevailing in the lower smaller driving pressure space 12 as a resultant of an effective counteraction of a load and operating pressure $P_A$ applied to the larger driving pressure space 11;
$F_2$ = an effective cross-sectional area of a narrower bore section 33;
$K_2$ = an upward acting force; and
$F_3$ = effective size of a difference surface 36 of the piston 21.

The rod-shaped smaller part of the piston moves up and down while in the narrower bore section 34 of the cylinder 19 while maintaining a pressure-tight seal, with the bore section 32 being separated by a housing step 32 from the cylinder bore 22 in which the larger part 31 of the piston moves up and down while maintaining a pressure-tight seal. The larger part 31 of the piston 21 has a cross-sectional $F_1$ and forms, for example, a single piece with the rod-shaped smaller part 34 of the piston 21, which at its free lower end carries the tool 16.

The pressure $P_G$, where $P_G < P$, acts on the effective size of the essentially annular difference surface 34, applied to the lower driving pressure space 12, with the pressure acting on the cylinder piston 21 in a sense of producing the upward-acting force K2.

When the hydraulic cylinder 13 is employed in a differential operating mode, i.e. when the outlet pressure $P_N$ or $P_H$ of the pressure source 23 is applied to both its driving pressure spaces 11 and 12, the magnitude of a maximum force $K_{3N}$ or $K_{3H}$ available for the forward feed and working movement of the tool 16 acting in the direction of the arrow 37 in parallel to the arrow 28, is respectively determined by the following equations:

$$K_{3N} = F_2 P_N \tag{3}$$

$$K_{3H} = F_1 \cdot P_H - F_3 \cdot P_H \tag{4}$$

As apparent from the above equations when the hydraulic cylinder 13 is being operated in a differential mode, it is only the cross section area $F_2$ of the smaller part 34 of the piston 21 that acts as an effective driving surface.

The control system 10 of the present invention effectively functions in the following manner.

In fast forward movement, i.e. a phase in which the tool 16 performs a feeding movement towards the work piece 14, which, in the illustrated embodiment is carried out in a downward direction, the hydraulic cylinder 13 is operated in the differential mode, with the pressure being at first applied via the low-pressure outlet 24 of the pressure source 23.

When the hydraulic cylinder 13 is being operated in this manner, the pressure that can be built up in its driving pressure spaces 11 and 12 will be sufficient to produce the force needed for the deformation of the work piece 14 in those cases in which the work piece 14 is of a relatively small thickness, so that in these cases the work piece 14 can, as it were, be processed in "fast forward" operation.

Given greater thicknesses of the work piece 14, when the pressure that can be made available at the low-pressure outlet 24 of the pressure source 23 is no longer sufficient to obtain the necessary (punching) deformation of the work piece 14, the control system 10 will activate a pressure-reversing valve 39 thereby causing the pressure supply to the hydraulic cylinder 13 to be taken from the high-pressure outlet 26 of the pressure source 23. The maximum pressure $P_H$ (about 180 bar) available at the high pressure outlet 26 in a typical design is substantially greater (for the purposes of the present example presumed to be three times as great) than the outlet pressure $P_N$ made available at the low-pressure outlet 24 of the pressure source 23, which pressure is in the order of 60 bar. Even after this switching of the pressure supply of the pressure source 23 to the higher pressure level the hydraulic cylinder 13 will still be operated in the differential mode, producing fast forward movement. But the forward driving force that can be exploited for the purposes of processing the work piece 14 will now be increased in proportion to the ratio PH/PN formed by the pressures available at the low pressure outlet 24 and high pressure outlet 26 of the pressure source 23.

If this greater forward driving force proves insufficient for processing the work piece 14, which will lead to a situation in which the operating pressure in the driving pressure spaces 11 and 12 of the hydraulic cylinder 13 will come to exceed a value that lies a preset amount (20 bar, for example) below the maximum outlet pressure at the high-pressure outlet 26 of the pressure source 23, a surfacereversing valve 42, controlled by the pressure prevailing in the larger driving pressure space 11 of the hydraulic cylinder 13, will be activated and switch the hydraulic cylinder 13 from the differential mode employed for fast forward operation to a mode in which, as shown in FIG. 1, only the larger driving pressure space 11 of the hydraulic cylinder remains connected to the high-pressure outlet 26 of the pressure source 23, while the pressure in the smaller and lower driving pressure space 12 of the hydraulic cylinder 13 is discharged into a non-pressurized tank 43 of the pressure source 23.

In this forward operation under load the maximum useful force available for driving the tool 16 forward is given by equation (4). As compared with fast forward operation, however, the speed is now reduced in proportion to the ratio $F_2/F_1$ formed by the effective working surfaces $F_1$ and $F_2$ of the smaller part 34 and the larger part 31 of the hydraulic cylinder piston 21.

As soon as the work piece 14 has been processed i.e. punched through in the example under consideration, the operating pressure $P_A$ in the larger driving pressure space 11 of the hydraulic cylinder 13 will suffer a drastic downturn and this, in turn, will cause the surface-reversing valve 42, provided that it had been previously activated, and the pressure-reversing valve 39 to return to their initial or basic positions associated with fast forward operation, so that the "last" part of the processing displacement of the work piece 14 can again be performed in "fast" forward operation.

On completion of the processing of the work piece 14, the hydraulic cylinder 13 is switched to fast return operation, in which the smaller driving pressure space 12, which is annular in shape, is connected to the low-pressure outlet 24 of the pressure source 23, while the pressure in the larger driving pressure space 11 is discharged into the non-pressurized tank 43 of the pressure source 23.

Control of the speed and distance of the feed and processing displacements and the return movements of the hydraulic cylinder piston 21, and therefore also of the tool 16 rigidly attached thereto, is obtained by a conventional electro-hydraulic follow-up adjusting valve that works with an electrically controlled indication of the set value and with mechanical feedback of the actual values. The electrical control is provided for example by a stepper motor. Conventional follow-up adjusting valves generally designated by the reference numeral 44 that can be used in the control system 10 as control valves for speed and displacement may be of the type disclosed, for example, in DE PS 20 62 134 or DE 36 30 176 Al, the contents of which are incorporated herein by reference as regards the structure and operation of such follow-up adjusting valves, including their control by stepper motors and their electronic drives.

These follow-up adjusting valves 44 are basically designed as 4/3-way valves, but With the hydraulic circuit periphery of the hydraulic cylinder 13 illustrated in FIG. 1 they can also be used as 3//3-way valves.

Consequently, the follow-up adjusting valve 44 is explained hereinbelow solely in the light of the functions it performs, but without specially discussing the numerous design possibilities available for obtaining these functions.

In the control system 10 of the present invention, the follow-up adjusting valve operates in the following manner:

When the stepper motor 46 rotates in one of its two possible directions of rotation such as, for example, in a clock-wise direction which, in FIG. 1, is indicated by the arrow 47, the follow-up adjusting valve 44 is switched from the illustrated basic or rest position 0, in which the larger driving space 11 is cut off from both the high pressure outlet 26 and low pressure outlet 24 of the pressure source 23 and from the non-pressurized tank, into an operating position I, in which the larger driving pressure space 11 of the hydraulic cylinder, according to the operating position of the pressure-reversing valve 39, is connected to either the low pressure outlet 24 of the pressure source 23 or the high pressure outlet 26.

The operating position I of the follow-up adjusting valve 44 is associated with a "forward" operation of the hydraulic cylinder 13, in which the tool 16 performs a fast forward feed, its power forward feed and sometimes also its working movement under load, as well as subsequent movement in the lower terminal position. The rotation of the stepper motor 46 takes place in an incremental manner, that is, the rotation is triggered by a sequence 48 of pulses 49 emitted by a programmable electronic control device 51 of conventional construction. The term "incremental" is here to be understood as meaning that whenever the stepper motor 46 is driven by one of the pulses 49, the rotor of the stepper motor 46 rotates through a definite and preset annular distance associated with a certain fraction of a stroke of the piston 21 of the hydraulic cylinder 13. By setting the number of pulses 49 by which the stepper motor 46 is to be driven as well as by virtue of a frequency of the pulses 49, both the path to be traveled by the piston 21 of the drive 13 and by the tool 16 and also the speed with which the forward movements of the tool 16 will be performed can be defined. When the actual position, monitored and announced by a mechanical feedback device generally designated by reference numeral 52 is equal to a set position, the follow-up adjusting valve 44 returns to the illustrated rest position 0.

The return movements of the hydraulic cylinder piston 21 and the tool 16 rigidly fixed thereto are controlled in an analogous manner, namely, the stepper motor 46 is driven by a pulse sequence 53 which causes the stepper motor 46 to rotate in a counter clockwise direction indicated by the arrow 55. This, in turn, switches the follow-up adjusting valve 44 into the operating position II, in which the upper driving pressure space 11 of the hydraulic cylinder, that is, the driving pressure space with the larger cross-section is connected to the non-pressurized tank 43 of the pressure source 23 but is cut off from the low pressure outlet 24 and the high pressure outlet 26.

In both the forward and return operation of the hydraulic cylinder 13, the greater the deviation of the tool 16 from the set position, the greater will be the through flow cross-section of the flow-path 54 or 56 by which the pressure is applied to the driving pressure space when the follow-up adjusting valve 44 is in the operating position I or is discharged into the nonpressurized tank 43 of the pressure source 23 when the follow-up adjusting valve is in the operating position II.

Whenever the actual position of the tool 16 is the same as the set position, the follow-up adjusting valve returns to the illustrated rest position 0.

The pressure-reversing valve 39 is a pressure-controlled 2/2-way valve and functions such that once the operating pressure PA in the larger driving pressure space 11 of the hydraulic cylinder 13 attains or exceeds a given threshold value $P_{A1}$, which for the purposes of the explanation is presumed to be 90% of the lower pressure $P_N$ available at the low-pressure output 24 of the pressure source 23, the pressure reversing valve 39 switches from its previous blocking position 0 into a throughflow position I, in which the high-pressure outlet 26 of the pressure source 23 is connected to the pressure supply connection P of the follow-up adjusting valve 44.

A non-return valve 58 is provided between the pressure supply connection 57 of the follow-up adjusting valve 44 and the low pressure outlet 24 of the pressure source 23, the non-return valve 58 being maintained in a blocking position whenever the pressure at the pressure supply connection 57 is greater than the pressure prevailing at the low-pressure outlet 24 of the pressure source. While the pressure-reversing valve 39 remains in a blocking position, it is through this non-return valve 58 that the operating pressure $P_N$, made available at the low-pressure outlet 24 of the pressure source 23, is applied to the pressure supply connection 57 of the follow-up adjusting valve 44.

When the hydraulic cylinder 13 obtains its pressure supply from the high-pressure outlet 26 of the pressure source 23, the non-return valve 58 prevents the pressure available at the high-pressure outlet 26 of the pressure source 23 from becoming connected to the low-pressure outlet 24.

In the embodiment illustrated in the drawings the pressure-reversing valve 39 is a slide valve with a housing that accommodates two bore sections 59 and 61 having different diameters. The two bore sections 59, 61 are separated by an annular step in the interior of the housing and terminate, respectively against face walls 63 and 64 of the housing.

A piston generally designated by the reference numeral 66 of the pressure reversing valve 39 has two end flanges 67 and 68 that slide, respectively, in the smaller bore section 59 and the larger bore section 61, so that the end flanges 67 and 68 constitute mobile but pressure-tight seals and respectively delimit the control pressure spaces 69 and 71 that respectively terminate against the face walls 63 and 64 of the valve housing.

The control pressure space 69 of the pressure-reversing valve 39, i.e. the one having the smaller diameter, is permanently connected to the low pressure outlet 24 of the pressure source 23.

The control pressure space 71 of the pressure-reversing valve 39, i.e. the one having the larger diameter, is connected to the operating pressure outlet 72 of the follow-up adjusting valve 44, which, in turn, communicates with the larger driving pressure space 11 of the hydraulic cylinder 13.

The large diameter end flange 68 is followed by a piston section 73 with a diameter corresponding to the diameter of the smaller bore section 59 of the valve housing 58 and the piston section 73 enables the valve slide 66 to constitute yet another mobile but pressure-tight seal in the smaller diameter bore section 59. A rod-shaped connecting piece 74 rigidly links the piston section 73 to the end flange 67 of the valve piston 66, where the flange 67 has a diameter corresponding to that of the smaller bore section 59 and the entire piston 66 is made from a single piece. The end flanges 67 and 68 are respectively provided with short bearing stubs 77 and 78, which are arranged along a longitudinal axis 76 of the pressure-reversing valve 39 and respectively extend towards the face walls 63 and 64, so that the piston 66, on attaining the positions corresponding to the operating positions 0 and I, will have a central support either against face wall 64 or against face wall 63, i.e. respectively the "lower" or "upper" face wall in the drawing. In a special design of the pressure-reversing valve 69, the effective cross-sectional area $f_2$ of the larger end flange 68 of its piston 66 is 10% greater than the effective cross-sectional area f1 of the smaller end flange 67 of the piston and one therefore has the following relationship:

$$f_2 = 1.1\, f_1. \tag{5}$$

Ingoring some very small frictional losses, the valve piston 66 will therefore be pushed into its basic position, which corresponds to the minimum volume of the larger control pressure space 71 and in the drawings is illustrated by lines, when and for as long as the operating pressure $P_A$ prevailing in the control pressure space 71, and, at the same time, also in the larger driving pressure space 11 of the hydraulic cylinder 13, is smaller than 1/1.1 times the value of the lower supply pressure Phd N made available at the low pressure output 24 of the pressure source 23 and permanently applied also to the smaller control pressure space 69 of the pressure-reversing valve 39, i.e. upon satisfying the following pressure relationship:

$$P_A \leqq P_N/1.1. \tag{6}$$

As long as the valve piston 66 remains in its basic position governed by this pressure relationship, an annular pressure input space 79 of the pressure-reversing valve 39, in which there permanently prevails the higher supply pressure $P_H$ made available at the high-pressure outlet 26 of the pressure source 23, will remain cut off from an annular pressure output space 81 of the pressure reversing valve 39, with the output space 81 being connected to the pressure supply connection 57 of the follow-up adjusting valve 44.

The input pressure space 79 of the pressure-reversing valve 39 illustrated in the basic position of the valve piston 66 as represented by solid lines in the drawing is permanently delimited by the smaller bore section 59 of the valve housing 58 and, axially and in a mobile manner, by the two opposite annular surfaces 82 and 83 of, respectively, the smaller end flange 67 of the valve piston 66 and the piston section 73 adjacent to the larger end flange 68 of said valve piston.

The output pressure space 81 of the pressure-reversing valve 39 is permanently delimited in the axial direction by an annular groove 84 cut in the smaller bore section 59 of the valve housing 58, which also constitutes the outer radial face of this space, while the inner radial face is constituted by the cylindrical skirting 86 of the smaller end flange 67 of the valve piston 66.

When the operating pressure $P_A$ in the larger driving pressure space 11 of the hydraulic cylinder 13 exceeds the value $P_N/1.1$, which will be the case as soon as the tool 16 comes into contact with the work piece 14 and, given differential operation of the hydraulic cylinder 13, the pressure made available at the low-pressure outlet 24 of the pressure source 23 "begins" to be no longer sufficient to permit the tool 16 to punch through the work piece 14. The governing relationship is as follows:

$$P_A \geqq P_N/1.1. \quad (7)$$

Thus, the valve piston 66 will be pushed into its operating position, which corresponds to the open position of the pressure-reversing valve 39 and is such that the control edge 82 constituted by the junction of the cylindrical skirting 86 of the smaller end flange 66 of the valve piston 66 and the annular face 82 of this end flange comes to lie within the clear width of the annular groove 84 that permanently delimits the pressure output space 81, so that the pressure input space 79 of the pressure reversing valve 39, having become "displaced" in an axial direction, is now put into communication with the pressure output space 81 of the valve. Consequently, the high-pressure outlet 26 of the pressure source 23 is connected to the supply pressure connection 57 of the follow-up adjusting valve.

In the operating position I of the pressure-reversing valve 39 the hydraulic cylinder 13 is operated at a higher pressure level, though, at least at first, still in the differential operating mode.

Following a pressure reversal obtained in this manner, the forward driving force that can be developed by the hydraulic cylinder 13 will be increased in the proportion of the ratio $P_H/P_N$.

If the forward driving force obtainable by differential operation of the hydraulic cylinder 13 is not sufficient to permit the tool 16 to punch through the work piece 14, the surface-reversing valve 42, which in accordance is a pressure-controlled 3/2-way valve, will cause the pressure to become discharged from the smaller annular driving pressure space 12, thereby ensuring that henceforth the entire cross section area $F_1$ of the larger piston section 31 can be exploited for the purpose of developing forward driving force, which in cases of maximum load, i.e. very thick work pieces, can thus be increased up to $F_1 \cdot P_H$. In this operatinq mode of the hydraulic cylinder 13, which is obtained by automatic switching of the surface-reversing valve 42, the possible forward speed will however become reduced in the proportion of the area ratio $F_2/F_1$.

Another function performed by the surface-reversing valve 42 is that, once the valve 42 has switched into its operating position that causes the pressure to become discharged from the annular driving pressure space 12 of the hydraulic cylinder 13 and thus makes it possible to exploit a greater forward driving force, the valve 42 will switch back into its operating position in which pressure will again be applied to the annular driving pressure space 12 only after the forward driving force required at the tool 16 to permit it, for example, to punch through the work piece 14 has dropped by a preset amount $\delta K$ below the forward driving force or pressure in the driving pressure spaces 11 and 12 of the hydraulic cylinder 13 that had to be exceeded before the surface-reversing valve 42 switched into the position that caused the pressure to become discharged from the annular driving pressure space 12. This not only permits one to exploit a high speed to advance the tool 16 for the longest possible time, but also ensures that, once the control system 10 has switched in the direction of a higher forward driving force, it will not "switch back too early" to a reduced forward driving force, which could produce undesired oscillations and, consequently, bring the tool 16 to a "standstill".

Figure 3:
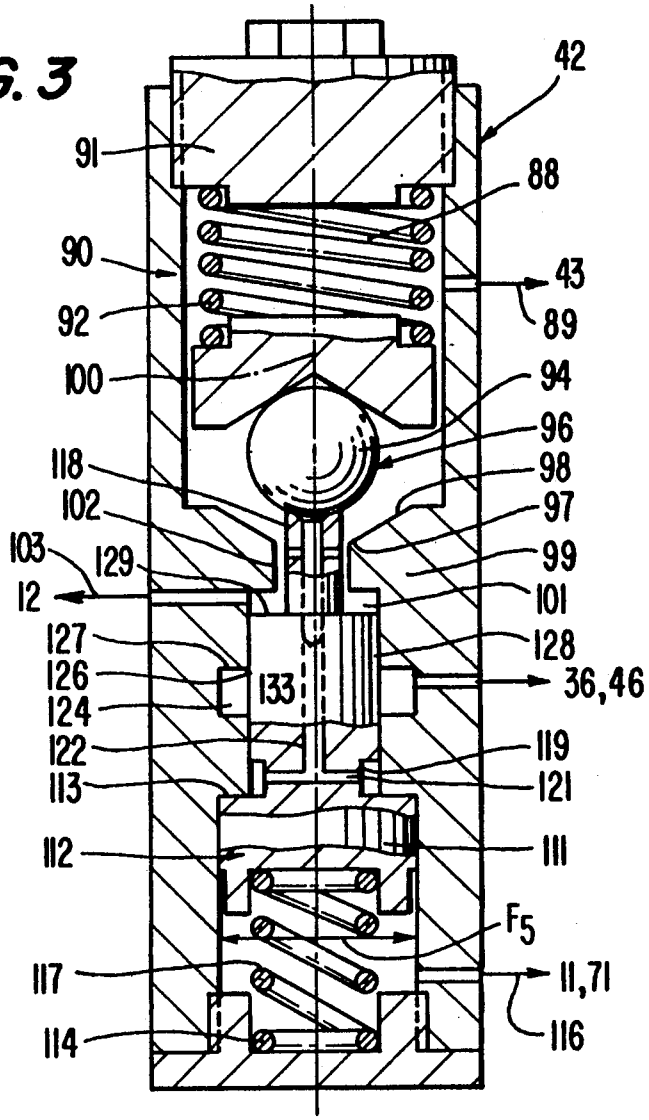
FIG. 3 is a cross-sectional view, on an enlarged scale, of a surface reversing valve of the control system of FIG. 1 in a second operating position.
Figure 2:
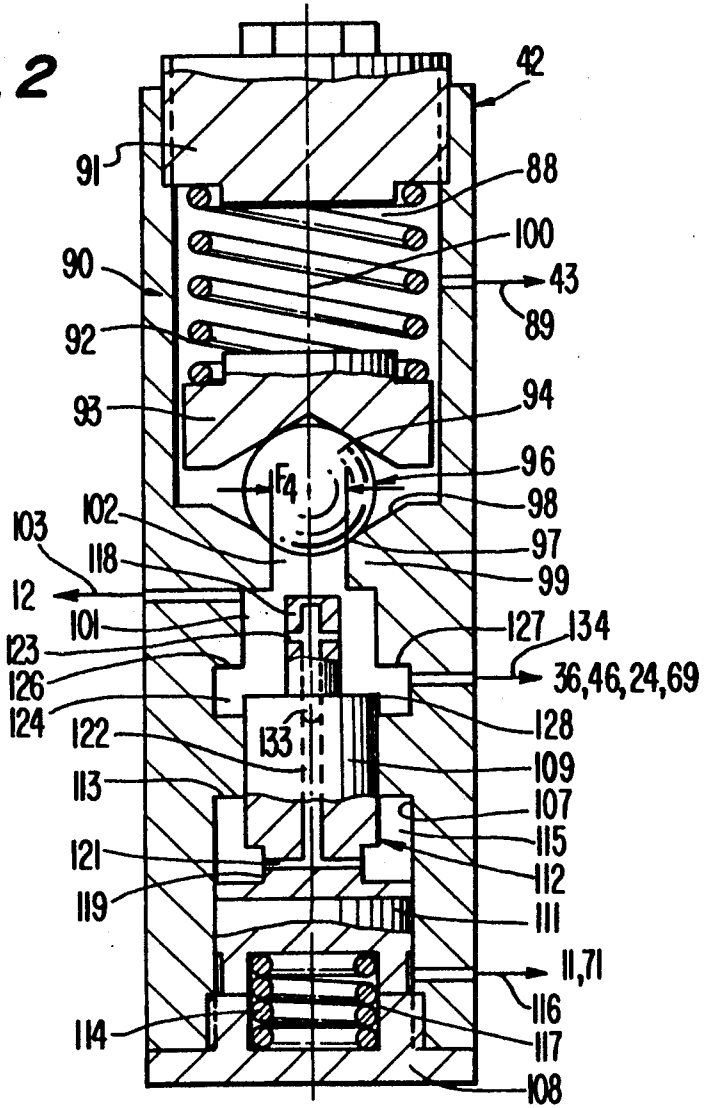
FIG. 2 is a cross-sectional view, on an enlarged scale, of a surface reversing valve of the control system of FIG. 1 in a first operating position.

As shown most clearly in FIGS. 2 and 3, the surface-reversing valve 42 comprises a first valve chamber 88, which, via a pressure-relieving flow path 89, is permanently connected to the tank 43 of the pressure source 23 and is therefore maintained in a non-pressurized state.

By a setting screw 91, which also constitutes one end face of the valve housinq generally designated by the reference numeral 90, this valve chamber 88 is hermetically sealed with respect to the outside. The initial compression of a valve closing spring 92 can be adjusted by turning the setting screw 91, the spring 92 being attached to a centering piece 93 that will push the ball-shaped valve body 94 of a seat valve generally designated by the reference numeral 96 against its seating 97, that is to say, into the closed position of the seat valve 96 The valve seating 97 is constituted by the inner edge, i.e., the one having the smaller clear diameter, of a conical recess 98 in a transverse wall 99 of the valve housing, with the recess 98 serving for centering the valve ball 94. Between this valve seating 97 and a central valve chamber 101 there extends a valve channel 102 that leads into the central valve chamber 101 . Via a first hydraulic control duct 103, the central valve chamber 101 remains in permanent communication with the smaller annular driving pressure space 12 of the hydraulic cylinder 13. The central valve chamber 101 is permanently delimited by a smaller-diameter bore section 104 of the stepped bore generally designated by the reference number 106 of the housing 90, while the bore section 107 with the larger diameter is closed in a pressure-tight manner at the other end of the housing 90 by a cover 108 that constitutes the face wall at this end of the valve housing 90.

Two piston sections 109, 111 of a step piston generally designated by the reference numeral 112 respectively slide inside two bore sections 104 and 107 of the step bore 106, with the diameters of the two piston sections 109, 111 being such so as to provide pressure-tight seals in their respective bore sections 104, 107. The smaller piston section 109 provides a mobile delimitation of the central valve chamber in the axial direction, while the piston section 111 with the larger diameter provides not only the mobile delimitation in the axial direction of an annular chamber 115 that in the other axial direction is permanently delimited by the annular housing step at the junction between the smaller bore section 104 and the larger bore section 107, but also constitutes the mobile delimitation in the axial direction of a control chamber 114 that at its other axial end is permanently delimited by the housing cover 108. Via a second hydraulic control duct 116, the control chamber 114 is maintained in permanent communication with the larger driving pressure space 11 of the hydraulic cylinder drive.

By a weakly compressed return spring 117 attached to the inner face of the housing cover 108, the step piston 112 is pushed in the direction of the valve ball 94, so that, in the basic position illustrated in FIG. 1, the stub-shaped extension 118 of the smaller piston section 109 bears against the valve ball 94. The outer diameter of this stub-shaped extension 118 is clearly smaller than the diameter of the valve channel 102 and it therefore passes readily through it. The smaller piston section 109 is separated from the larger piston section 111 by a constriction 119 in the form of an annular groove, within which there is situated the radial bore 121, both ends of which therefore terminate in an annular chamber 115. Via a longitudinal boring 122 passing through a center of the smaller piston section 109 and stub-shaped extension 118 and one or more radial bores 123 within the stub-shaped extension 118, this radial boring 121 remains in permanent communication with the central valve chamber 101.

As viewed in the direction of the longitudinal axis 100 of the valve housing 90, the bore section 104 with the smaller diameter has, at a center thereof, an annular enlargement 124 that, via a third control or pressure supply duct, remains permanently connected to the low-pressure outlet 24 of the pressure source 23. The interior edge 126 of the side of the groove or enlargement 127 facing the central valve chamber 101, i.e. the upper edge in FIG. 1, constitutes a fixed control edge with which the outer edge 128 of the annular surface 129 of the smaller piston section 109 that delimits the central valve chamber 101 can cooperate as a mobile control edge.

In the basic position of the step piston 112, illustrated in FIG. 1, the mobile control edge 128 of the step piston 112 finds itself in a position of positive overlap with the fixed control edge 126, the overlap $\delta X_1$ amounting to only a small fraction of the stroke $X_1$ that the step piston 112, starting from its illustrated basic position, can perform in the opening direction of the seat valve 96, i.e. in the direction of the arrow 131, and corresponding also to no more than a small fraction of the stroke $X_2$ that the step piston 112 can perform in the opposite direction, i.e. in the direction of the arrow 132.

In the illustrated basic position of the step piston 112 the annular chamber delimited by the annular groove-like enlargement 124 and the smaller piston section 109, notwithstanding the overlap $\delta X_1$ between the mobile control edge 128 and the fixed control edge 126, is not hermetically sealed off from the central valve chamber 101, but rather remains in communication with it via a peripheral edge notch 133 having a small overflow cross section, though this channel becomes closed as soon as the step piston has performed a small fraction $\delta X_2$ of its possible stroke in the direction of the arrow 131, after which the annular groove-like enlargement 124 of the smaller bore section 104 still communicates with the low-pressure outlet 24 of the pressure source 23, but becomes sealed off from the central valve chamber 101. The initial compression of the valve-closing spring 92 is or has to be chosen in such a way that the force with which the valve ball 94 is pushed against the circular contour of the seating will correspond approximately to the force of about, 90% thereof, that will act on the valve ball 94 when, through the circular opening bordered by the valve seating 97, it becomes subject to a pressure corresponding to the maximum pressure that the pressure source 23 can make available at its high-pressure outlet 26.

Such a high pressure can be applied to the central valve chamber 101 when the tool 16, during differential operation of the hydraulic cylinder 13 and following a switching of the pressure reversing valve 39—becomes subject to the high output pressure PH that, via the follow-up adjusting valve 44, is applied also to) the larger driving pressure space 11 of the hydraulic cylinder 13.

Assuming the maximum pressure made available by the pressure source 23 at its high-pressure outlet 26 amounts to about 180 bar, the initial compression of the closing spring 92 will therefore be set in such a manner so as to make the pressure source 23 exert a "closing pressure" equivalent to 162 bar.

By comparison, the setting of the return spring 117 is negligibly small and equivalent to a pressure of no more than 5 bar, for example. If F4 represents the area of the circular opening bordered by the valve seating 97 through which there can act on the valve ball 94 the pressure that, via the first hydraulic control duct 103, can be built up in the driving pressure space 11 of the hydraulic cylinder and applied to the central valve chamber 101 of the surface-reversing valve 42 and, further, $F_5$ designates the cross section area of the larger piston section 111 of the step piston 112 to which there is applied the output pressure of the follow-up adjusting valve 44 that is applied also to the larger driving pressure space 11 of the hydraulic cylinder, the two areas F4 and F5 will be chosen a so as to satisfy the following relationship:

$$F_5/F_4 > P_H/P_N, \tag{8}$$

where: $P_H$ and $P_N$ represent the pressures that the pressure source 23 makes available at, respectively, the high-pressure outlet 26 and the low-pressure outlet 24 and which, in the special explanatory example here considered, stand to each other in a ratio of 3/1.

The annular chamber 124 of the surface reversing valve 42 communicates with the smaller control pressure space 69 of the pressure reversing valve 39 via a first control duct 134.

Furthermore, the control chamber 114 of the surface-reversing valve 42, which the larger piston section 111 delimits in a mobile manner, is connected to the larger control pressure space 71 of the pressure-reversing valve 39 via a second control duct 116.

Presuming further that the area ratio $F_1/F_2$ of the hydraulic cylinder drive 13 amounts to 2 and that F1, which designates the larger piston surface 27 of the piston 21 of the hydraulic cylinder drive 13, amounts to 100 $cm^2$.

In a typical working cycle, the control system 10 operates as follows:

When the pressure source 23 is switched on to bring the whole of the drive and control system 10 into operation, the follow-up adjusting valve 44 is first steered into its operating position II, because in this manner the tool 16 of the hydraulic cylinder 13, as a preparatory move, will be brought into a definite starting position, for example, an upper terminal position. Consequently, the larger driving pressure space 11 of the hydraulic cylinder 13 and the control chamber 114 of the surface-reversing valve 42 will become depressurized by being connected to the non-pressurized tank 43 of the pressure source 23, while the output pressure $P_N$ made available at the low-pressure outlet 24 of the pressure source 23 is applied not only to the annular groove-like enlargement 124 of the housing 90 of the surface reversing valve 42, to the central valve chamber 101 and the annular chamber 115 of this valve and, via the first hydraulic control duct 103, to the annular driving pressure space 12 of the hydraulic cylinder 13, but also, via the first control duct 134 of the pressure-reversing valve 39, to the smaller control pressure space 69 of the valve.

The larger-diameter control pressure space 71 of the pressure-reversing valve 39, which, via the second control duct 116 of the pressure-reversing valve 39, is connected to the control chamber 114 of the surface-reversing valve 42, the chamber 114 being delimited in a mobile manner by the larger piston section 111 of the step piston 112 of the surface-reversing valve 42, is likewise depressurized by being connected to the non-pressurized tank 43 of the pressure source 23. Consequently, the pressure-reversing valve 39 will be maintained in its basic position as illustrated in FIG. 1 and, in this position, the lower output pressure of the pressure $P_N$ source 23 is not only connected via the non-return valve 58 to the pressure supply connection 57 of the follow-up adjusting valve 44, but also applied directly to the annular enlargement 124 of the surface-reversing valve 42.

In this operating condition of the control system 10 and the follow-up adjusting valve 44 the piston 21 of the hydraulic cylinder 13 is first brought into its upper terminal position, which is the basic position illustrated in FIG. 1, while the step piston 112 of the surface-reversing valve 42, which is subjected to the output pressure $P_N$ of the pressure source 23 applied to the cross section area $F_5$ of its larger piston section 111, is pushed into its lower terminal position, i.e. the one furthest removed from the valve ball 94, as shown in FIG. 2.

This operating position of the surface-reversing valve 42, combined with the operating position II of the follow-up adjusting valve 44, corresponds to the return-movement mode of operating the hydraulic cylinder 13, a phase in which the cylinder returns to its initial position after the tool 16 has performed its working stroke.

When the hydraulic cylinder piston 21, starting from its basic position, is to be operated in the forward-motion mode, the follow-up adjusting valve 44, controlled via the stepper motor 46 the and sequence 49 of "forward" control pulses, is switched into its operating position I.

Consequently both the larger, upper driving pressure space 11 of the hydraulic cylinder 13 and the control chamber 114 of the surface reversing valve 42, as well as the larger control pressure space 71 of the pressure-reversing valve 39, become subject to the output pressure $P_A$ of the follow-up adjusting valve 44, which can be regulated as from time to time required via the state of aperture of the throughflow flow-path 54 of the follow-up adjusting valve 44.

In this differential operating mode of the piston 21 of the hydraulic cylinder 13, which is associated with fast forward operation of the piston in no-load conditions, the pressure PA that has to be applied to the larger driving pressure space 11 of the hydraulic cylinder 13 if the piston 21 and the tool 16 are to be moved in the direction of the work piece 14 need only be slightly greater than the value of $P_N \cdot F_3/F_1$, so that, in the explanatory example here considered, it need therefore be only slightly greater than $P_N/2$ and may therefore be much smaller than the pressure $P_N$ made available at the low-pressure outlet 24 of the pressure source 23, which is at first utilized for controlling the fast forward motion of the hydraulic cylinder piston 21. In such a phase of fast forward motion, the pressure-reversing valve 39 will therefore remain in its illustrated basic position, just as the surface-reversing valve 42 will remain in its operating position I as shown in FIG. 2, because the smaller control pressure space 69 of the pressure-reversing valve 39, as also the annular enlargement 124 of the valve housing, which in this operating position of the surface-reversing valve 42 communicates with the central valve chamber 101, are subject to a clearly greater pressure, namely the pressure $P_N$, while the control pressure space 71 of the pressure reversing valve 39 and the control chamber 114 of the surface-reversing valve 42, in which there prevails "only" the output pressure $P_A$, so that they are subject to a clearly smaller pressure that is only barely greater than $P_N/2$.

As soon as the tool 16 comes into contact with the work piece 14, so that a markedly greater resistance is opposed to the forward movement of the tool 16, the throughflow cross section of flow-path 54 inside the follow-up adjusting valve 44 becomes increased, this as a result of the increasing difference between the stepper-motor-controlled indication of the preset position and the actual position of the tool 16 as announced by the repeater mechanism 52. Consequently, the pressure applied to the larger driving pressure space 11 of the hydraulic cylinder 13, and therefore also to the larger control pressure space 71 of the pressure-reversing valve 39 and the control chamber 114 of the surface-reversing valve 42, will now increase.

When the forward driving force $K_3$ that can be obtained in this way, its value is given by equation (3), is sufficient to permit the tool 16 to punch through the work piece 14, i.e. to perform the working stroke, this phase of the cycle will be carried out in the differential operating mode of the hydraulic cylinder 13 and with the pressure supply obtained from the low-pressure outlet 24 of the pressure source 23. A jerking acceleration of the hydraulic cylinder piston 21 after the work piece 14 has been punched through need not be feared, because control of the movements of the hydraulic cylinder piston 21 and the tool 16 remains of the follow-up type and an excessively fast "pass" of the tool 16 through the control can be braked in a "sufficiently soft" manner and undesirable jarring of the machine can therefor be avoided.

When the forward driving force that can be obtained by differential operation of the hydraulic cylinder 13 and with the pressure supply obtained from the low-pressure output 24 of the pressure source 23 is not sufficient to permit the tool 16 to punch through the work piece 14, so that the output pressure PA of the follow-up adjusting valve 44 will come "closer and closer" to the output level $P_N$ of the low-pressure outlet 24 of the pressure source 23, there will come a moment when the output pressure $P_A$ of the follow-up adjusting valve 44 attains or exceeds the value given by equation (7) and, consequently, the pressure-reversing valve 39 will switch to its operating position alternative to the basic position shown in FIG. 1. In the new position, which is indicated by dotted lines, the high-pressure outlet 26 of the pressure source 23 will now be connected to the pressure supply connection 57 of the follow-up adjusting valve 44, while the non-return valve 58 will ensure that the said connection is cut off from the low-pressure outlet 24 of the pressure source 23.

The consequence of this is that even though the hydraulic cylinder 13 continues to be operated in the differential mode, a higher pressure level now prevails both in the larger driving pressure space 11 and in the smaller annular driving pressure space 12, so that, given the area and pressure ratios here considered—the maximum force with which the tool 16 can carry out its working stroke is now increased to three times the force that could previously be obtained while the pressure was being supplied from the low-pressure outlet 24 of the pressure source 23.

In the case of the illustrated embodiment this means that in place of a maximum forward driving force of 30,000 N/1.1, the machine now has at its disposal a forward driving force that has its upper limit at 90,000 N for as long as the hydraulic cylinder 13 continues to be operated in the differential mode.

When the maximum forward driving force that can be developed by the hydraulic cylinder in accordance with equation (4) is no longer sufficient to permit the tool 16 to punch through the work piece 14, the follow-up adjustment control will bring about an increase of the pressure in the larger driving pressure space 11 of the hydraulic cylinder 13 that will at first bring this pressure into the "neighborhood" of the pressure level available at the high-pressure outlet 26 of the pressure source 23. The step piston 112 of the surface-reversing valve 42 is now to all intents and purposes depressurized, because, both via the central valve chamber 101 and the annular chamber 115, as also via the lower control chamber 114, the step piston 112 is now subject to pressures that correspond either to the high output pressure $P_H$ of the pressure source 23 or are close approximations of this pressure, so that it may be considered as "neutrally" loaded. In this operating state of the surface-reversing valve 42 the relatively weak return spring 117 is quite sufficient to displace the step piston 112 in the direction of the valve ball 94 and actually bring it into contact with the valve ball 94, i.e. into the position illustrated in FIG. 1. If the pressure on the larger driving pressure space 11 of the hydraulic cylinder continues to increase as a result of the resistance that the work piece 14 opposes to the progress of the tool 16, the pressure exerted on the area $F_4$ surrounded by the valve seating 97 will eventually become sufficient to overcome the action of the valve-closing spring 92 and to lift the valve ball 94 out of its seating 97, thus interrupting the previously existing communication, made possible by the notch 133, between the central valve chamber 101 and the groove-shaped enlargement 124 subject to the high output pressure $P_H$ of the pressure source 23. The step piston 112 thus arrives in its "upper" terminal position illustrated in FIG. 3, and in this position the pressure acting on the annular driving pressure space 12 becomes discharged into the non-pressurized tank 43 of the pressure source 23 via the central valve chamber 101 and the valve chamber 88 situated "above" it, with the latter chamber 88 being in any case depressurized. The surface-reversing valve 42 has thus "switched". At this stage the high output pressure of the pressure source 23 acts solely and exclusively on the upper and larger driving pressure space 11 of the hydraulic cylinder 13, which is now operated in the mode for forward movement under load and performs the working stroke, the part of the cycle in which the work piece 14 is actually processed, with enhanced forward driving force but at a lesser speed. In this forward operating mode, in which the hydraulic cylinder 13 is essentially used with pressure applied to only "one side" of its piston 21, the maximum forward driving force in the conditions of the chosen example amounts to 180,000 N.

Once the work piece 14 has been processed, i.e. punched through in the example, the load removal will cause the pressure on the larger driving pressure space 11 of the hydraulic cylinder 13 to drop back, and a corresponding pressure drop will occur also in the control chamber 114 of the surface-reversing valve 42 and the larger control pressure space of the pressure-reversing valve 39, while the smaller control pressure space 69 will continue to be subject to the pressure $P_N$ made available at the low-pressure outlet 24 of the pressure source 23, i.e. 60 bar.

If the operating pressure $P_A$, which is controlled and maintained in line with requirements by the follow-up adjusting valve 44, drops below its lower limiting value as given by equation (7), i.e. becomes less than $P_N/1.1$ or, for example, 55 bar, the pressure-reversing valve 39 will switch back to the basic position illustrated in FIG. 1, so that the pressure supply will now once again be obtained from the low-pressure outlet 24 of the pressure source 23. The operating pressure $P_A$, which still acts on the larger driving pressure space 11 of the hydraulic cylinder 13, is not necessarily "cancelled" by this state of affairs, because the follow-up adjusting valve 44, by increasing the available throughflow path 54, can still "maintain" an operating pressure of the order of 55 bar or slightly less.

Only when the operating pressure $P_A$, due to the decreasing resistance that the work piece 14 oppose to the tool 16 during the final phase of its processing, has dropped even further, i.e. below the value of, for example, 50 bar, at which the pressure applied to the area $F_5$ of the larger piston section 111 is still such as to permit the step piston 112 of the surface-reversing valve 42 to overcome the action of the valve-closing spring 92 and to maintain the seat valve 96 open, will the surface-reversing valve 42 return to its closed position illustrated FIG. 1, because the valve closing spring 92 will then be able to push the piston 112 back to its basic position, and in this position the hydraulic cylinder 113 is once again operated in the differential mode, i.e. with, at the very most, the low output pressure $P_N$ of the pressure source 23 applied to both sides of its piston 21.

For the purposes of a generalized formulation of the dimensioning relationships that have just been stated with the help of a special embodiment example, it can be said that the pressure-reversing valve 39 will switch whenever the instantaneous operating pressure $P_A$ applied to the greater driving pressure space 11 of the hydraulic cylinder 13 either exceeds or understeps the value $P_N \cdot b_1$, where $b_1$ stands for a coefficient that is smaller than unity and corresponds to the ratio $f_1/f_2$ between the areas $f_1$ and $f_2$ of the end flanges 67 and 68 of the valve slide 66 of the pressure-reversing valve.

For proper functioning of the pressure-reversing valve the values of $b_1$ will lie between 0.85 and 0.95, preferably close to 0.9.

With regard to the surface-reversing valve 42, it should switch from the position in which it causes the smaller driving pressure space 12 of the hydraulic cylinder 13 to become relieved of pressure whenever the operating pressure $P_{AF}$ drops below $P_N \cdot b_1$.

The value of PAF is given by the following equation:

$$P_{AF} = K_R/F_5, \tag{9}$$

where $K_R$ represents the force exerted by the valve closing spring 92 of the non-return valve 96 of the surface-reversing valve 42.

The closing force $K_R$, in turn, is given by the following equation:

$$K_R = (P_H - \delta P) \cdot F_4, \tag{10}$$

where $\delta P$ stands for a pressure difference that corresponds to a small fraction of, for example, 10%, of the higher supply pressure $P_H$ made available at the high-pressure outlet 26 of the pressure source 23.

Equation (10) can also be written in the equivalent form as follows:

$$F_R = b_2 \cdot P_H \cdot F_4, \tag{11}$$

where $b_2$ once again stands for a coefficient that is smaller than unity and could amount, for example, to 0.85 to 0.95, preferably close to 0.9. Taking due account of equations (9), (10) and (11), it can be seen that the requirement that the surface-reversing valve 42, in the terminal phase of the working cycle, should "switch back" into the operating position where it causes the hydraulic cylinder 13 to operate in differential mode only after the pressure-reversing valve 39 has already switched into its operating position in which the hydraulic cylinder will again draw its pressure supply from the low-pressure outlet 24 of the pressure source 23 can be satisfied if one makes sure that the ratio $F_4/F_5$ between the cross section area $F_4$ of the opening surrounded by the valve seating 97 and the working surface $F_5$ of the step piston 112 of the surface-reversing valve 42 will comply with the relationship $$F_4/F_5 < (b_1 \cdot P_N)/(b_2 \cdot P_H), \quad (12),$$

which can also be written in the following form:

$$F_4/F_5 \leqq (b_1 \cdot P_{N+a})/(b_2 \cdot P_H), \quad (13),$$

where a stands for a small safety margin that may have a value of between 2% and 10% and should preferably be of the order of 5%.

I claim:

1. A hydraulic control system for a drive control of a double-acting hydraulic cylinder means forming a drive unit for a working tool means of a processing machine for processing a work piece by subjecting the same to cold deformation such as punching or embossing, said double-acting hydraulic cylinder means being adapted to drive the tool means in a fast forward movement in a course of a processing cycle towards the work piece, a working stroke during which the work piece is actually formed, and fast return movement for bringing the tool back into a starting position for a next processing cycle, the hydraulic control system comprising:

a driving piston having a double-diameter forming a large size and a small size piston surface defining a large and a small size driving pressure space;

a pressure source means for supplying driving and or operating pressures by applying pressure to both piston surfaces to control the feed and working movements of the total during fast forward operations, said pressure source means including a first pressure outlet means for supplying pressure at a relatively low pressure and a second pressure outlet means for supplying pressure at a markedly higher pressure level, whereby, when pressure is applied only to the large piston surface of the driving piston, while the smaller piston surfaces relieved of pressure, forward working movements under load calling for a greater forward diving force are controlled, and, when pressure is applied only to the small piston surface of the driving piston, while the larger piston surface is relieved of pressure, the fast return movements of the tool are controlled;

an electrically-controlled directional control valve means for controlling a stroke of forward and return movements of the tool means, said electrically-controlled directional control valve means being swtichable into alternative opening positions, with one position causing pressure to be applied to the large driving pressure space of the hydraulic cylinder means delimited by the large piston surface of the driving piston, and in a second position depressurizing the large driving pressure space, said electronically-controlled directional control valve means including an adjusting valve means operable with an electrically-controlled indication of a set value and controlled by a feedback of an actual position whereby it is possible to obtain a continuous variation of an operating pressure prevailing in the large driving pressure space of the hydraulic cylinder means;

a surface-reversing valve means, controlled by the pressure prevailing in the large driving pressure space of the hydraulic cylinder means swtichable from an operating position associated with the fast forward operations in which a pressure outlet of the pressure source means is connected to the small pressure space of the hydraulic cylinder means delimited by the small piston surface, into an alternative position associated with the fast forward motion under a greater load in which the small driving pressure space of the hydraulic cylinder means is relieved of pressure, and swtichable back into the operating position by discharging the pressure from the large driving pressure space of the hydraulic cylinder in which the small driving pressure space of the hydraulic cylinder means is again connected to the pressure outlet means of the pressure source means, the switching of the surface-reversing valve means to fast forward operation of the hydraulic cylinder means under load is effective when the pressure in the large driving pressure space of the hydraulic cylinder means exceeds a value corresponding to a large fraction of maximum obtainable operating pressure of the pressure source means, and the subsequent switching of the surface-reversing valve means into the operating position associated with the fast forward and return movements of the hydraulic cylinder means is effected when the operating pressure prevailing in the large driving pressure space of the hydraulic cylinder means understeps a value corresponding to a substantially smaller fraction of a maximum operating pressure of the hydraulic means;

a pressure-reversing valve means controlled by the operating pressure prevailing in the large driving pressure space of the hydraulic cylinder means and which, when and for as long as the operating pressure prevailing in the large driving pressure space of the hydraulic cylinder means remains smaller than a switching threshold corresponding to a large fraction of the output pressure supplied by the low pressure outlet means, connects the low-pressure outlet means to a pressure supply connection means of the adjusting valve means and, alternatively, when and for as long as the operating pressure prevailing in the large driving pressure space remains above this switching threshold, connects the high-pressure outlet means to the pressure supply connection means of the adjusting valve means; and wherein said surface-reversing valve means is constructed such that a switching threshold, upon being understepped triggers a switching back of the surface reversing valve means into the operating position associated with the fast operating movements of the hydraulic cylinder means is lower than a switching threshold of the pressure reverse valve means.

2. A hydraulic control system according to claim 1, wherein the pressure-reversing valve means comprises a pressure-controlled 2/2-way valve means that, for as long as the pressure in the large driving pressure space of the hydraulic cylinder means remains lower that a switching threshold, is maintained in a basic position in which the pressure supply connection means of the adjusting valve means is cut off from the high-pressure outlet means of the pressure source means and further, when and for as long as the pressure in the large driving pressure space of the hydraulic cylinder means is higher than the switching threshold switches into an open position in which the high-pressure outlet means is connected to the pressure supply connection means of the adjusting valve means, and wherein a non-return valve means is inserted between the pressure supply connection means of the adjusting valve means and the low-pressure outlet means of the pressure source means that is maintained in its closed position for as long as the pressure at the pressure supply connection means of the adjusting valve means is higher than the output pressure of the low-pressure output means of the pressure source.

3. A hydraulic control system according to claim 2, wherein the pressure-reversing valve means includes a slide valve means having a piston displaceable into a basic position by a return force of pre-set magnitude and a control end flange means for delimiting in a mobile manner one side of a control pressure space, an area of a surface of said end flange being so dimensioned that a force that has to be exerted in order to cause the pressure reversing valve means to switch into an operating position in which the high-pressure outlet means of the pressure source means is connected to the pressure supply connection means of the adjusting valve means requires a pressure determined by the following relationship:

$$P_A \leqq P_N \cdot b_1,$$

where: $P_N$ = pressure supplied by the lower pressure outlet means of the pressure source means; and $b_1$ = a coefficient that is smaller than unity.

4. A hydraulic control system according to claim 3, wherein the valve piston means of the pressure reversing valve means includes another end flange means at an end facing away from the control pressure space, in which prevailing operating pressure is the same as the output pressure of the adjusting valve means applied to the large driving pressure space of the hydraulic cylinder means, said another end flange means forming a mobile delimitation of a control pressure space of the pressure reversing valve means the output pressure of the low-pressure outlet means of the pressure source means permanently prevails.

5. A hydraulic control system according to claim 4, wherein a ratio the areas of the surfaces of the end flange means to which there are applied, respectively the output pressure of the adjusting valve means and the output pressure of the low pressure outlet means of the pressure source means, has the value of $b_1$, and wherein the valve piston means of the pressure reversing valve means is a free piston.

6. A hydraulic control system according to any one of claims 1, 2, 3, 4 or 5, wherein a valve element of the surface-reversing valve means in an open position causes the pressure to be discharged from the small driving pressure space of the hydraulic cylinder means, said valve element is a non-return valve that in an opening direction sustains the pressure of the small driving pressure space of the hydraulic cylinder means prevailing in a central valve chamber means of the surface-reversing valve, a force with which a precompressed valve closing spring pushes a valve body means of the non-return valve means into a blocking position is equivalent to an opening pressure corresponding to a large fraction of the high pressure made available at the high-pressure outlet means of the pressure source means, the surface-reversing valve means comprises another valve element formed as a slide valve means that, for as long as the non-return valve remains in the blocking position, assumes an open position in which the lower output pressure of the pressure source means from the low pressure means is applied to the small driving pressure space of the hydraulic cylinder means and, upon an opening of the non-return valve means switches into a blocking position, in which the small driving pressure space of the hydraulic cylinder means is cut off from the low-pressure outlet means of the pressure source means, said slide valve means of said another valve element includes a step piston means that a weakly precompressed return spring means pushes into a supporting contact with a valve body means of the non-return valve means and which is maintained in an operating position in which even a displacement of the step piston means amounting to no more than small fraction of an opening stroke of the non-return valve means or the closing stroke of the slide valve means will be sufficient to bring the slide valve means into the blocking position, in which one side of the step piston means becomes depressurized, while a control surface of the other side of the step piston means in which prevails the pressure of the large driving pressure space of the hydraulic cylinder means becomes subject to this pressure, and wherein, further, that a ratio between the control surface of the step piston means and cross sectional area surrounded by valve setting means of the non-return valve means, so that within the cross-sectional area the valve body means becomes subject to the pressure prevailing in the small driving pressure space of the hydraulic cylinder means for as long as the non-return valve means remains in the blocking position, satisfies the relationship:

$$F_4/F_5 \leqq (b_1 \cdot P_N + a)/(b_2 \cdot P_H),$$

where:

$F_4$ = cross-sectional area surrounded by the valve seating means;

$F_5$ = control surface of the step piston;

$b_1$ = a coefficient less than unity;

$P_A$ = operating pressure in large driving pressure space;

$P_H$ = maximum pressure supplied from high-pressure source means;

$b_2$ = a coefficient less than unity that defines an amount by which the operating pressure at which seat valve means opens may understep a maximum possible operating pressure; and a = for a small safety margin.

7. A hydraulic control system according to claim 6, wherein $b_1$ has a value of between 0.85 and 0.95, and wherein $b_2$ has a value of between 0.8 and 0.95.

8. A hydraulic control system according to claim 7, wherein $b_1$ is equal to 0.9.

9. A hydraulic control system according to claim 8, wherein $b_2$ is equal to 0.9.

10. A hydraulic control system according to claim 6, wherein a ratio between the cross-sectional area of the large driving pressure space of the hydraulic cylinder means and the cross-sectional area of the small working surface of the hydraulic cylinder means between 1.5 and 3.

11. A hydraulic control system according to claim 10, wherein the cross-sectional area of the large driving pressure space of the hydraulic cylinder means has an area of between 60 $cm^2$ and 300 $cm^2$.

12. A hydraulic control system according to claim 11, wherein a ratio between the output pressures of the high pressure outlet means and low pressure outlet means of the pressure source means has a value between 4 and 2.

13. A hydraulic control system according to claim 12, wherein an output pressure level at the low pressure outlet means of the pressure source means is between 50 bar and 80 bar.

14. A hydraulic control system according to claim 13, wherein the output pressure level is about 60 bar.

15. A hydraulic control system according to claim 12, wherein the value of the ratio is approximately 3.

16. A hydraulic control system according to claim 11, wherein the cross-sectional area of the large driving pressure space is 100 $cm^2$.

17. A hydraulic control system according to claim 10, wherein the ratio has a value of approximately 2.

18. A hydraulic control system according to claim 6, wherein the large fraction of the high-pressure at the high-pressure outlet means is between 0.85 to 0.95.

19. A hydraulic control system according to claim 3, wherein $b_1$ is in a range between 0.85 to 0.95.

20. A hydraulic control system according to claim 1, wherein the large fraction of the maximum obtainable operating pressure is about 85%.

21. A hydraulic control system according to one of claims 1 or 12, wherein the substantially smaller fraction of the maximum operating pressures is in a range of between 30% to 50%

22. A hydraulic control system according to claim 21, wherein the large fraction of the output pressure supplied by the low pressure output means is between 85% to 95%.

23. A hydraulic control system according to claim 22, wherein the feedback is effected by a step motor means operatively associated with a worm gear means.

* * * * *